US005924242A

United States Patent [19]

Macari et al.

[11] Patent Number: 5,924,242

[45] Date of Patent: Jul. 20, 1999

[54] SAFETY GATE

[75] Inventors: Jason Macari, Cumberland; Brian H. Ordung; Randy L. Abrams, both of Woonsocket, all of R.I.

[73] Assignee: Safety 1st, Inc., Chestnut Hill, Mass.

[21] Appl. No.: 08/739,008

[22] Filed: Oct. 28, 1996

[51] Int. Cl.[6] ..... E06B 3/68

[52] U.S. Cl. ..... 49/55; 49/57; 49/463

[58] Field of Search ..... 49/55, 50, 57, 49/463, 465

[56] References Cited

U.S. PATENT DOCUMENTS

| | | | |
|---|---|---|---|
| 604,411 | 5/1898 | Motley . | |
| 980,535 | 1/1911 | Kleinegger . | |
| 1,013,118 | 1/1912 | Brandt . | |
| 1,352,372 | 9/1920 | Kessler . | |
| 1,953,000 | 3/1934 | Ludwick | 156/33 |
| 2,436,344 | 2/1948 | Winogrond | 98/94 |
| 2,756,469 | 7/1956 | Cattermole et al. . | |
| 2,928,146 | 3/1960 | Kuniholm . | |
| 3,000,063 | 9/1961 | Hoog . | |
| 3,163,205 | 12/1964 | Gottlieb . | |
| 3,489,201 | 1/1970 | Curry, III et al. | 160/225 |
| 4,088,353 | 5/1978 | Meyer | 292/36 |
| 4,492,263 | 1/1985 | Gebhard | 160/228 |
| 4,607,455 | 8/1986 | Bluem et al. | 49/55 |
| 4,846,246 | 7/1989 | Stern | 150/224 |
| 4,944,117 | 7/1990 | Gebhard et al. | 49/55 |
| 4,968,071 | 11/1990 | Stern | 292/150 |
| 5,052,461 | 10/1991 | Stern | 160/224 |
| 5,134,806 | 8/1992 | Burkart, Jr. | 49/463 |
| 5,272,840 | 12/1993 | Knoedler et al. | 49/463 |
| 5,367,829 | 11/1994 | Crossley et al. | 49/465 |
| 5,437,115 | 8/1995 | Freese et al. | 49/465 |
| 5,442,881 | 8/1995 | Asbach et al. | 49/465 |
| 5,528,859 | 6/1996 | Taylor et al. | 49/465 |
| 5,535,552 | 7/1996 | Stern | 49/465 |
| 5,570,543 | 11/1996 | Bishop | 49/465 |

FOREIGN PATENT DOCUMENTS

| | | |
|---|---|---|
| 211486 | 11/1956 | Australia . |

*Primary Examiner*—Jerry Redman
*Attorney, Agent, or Firm*—Wolf, Greenfield & Sacks, P.C.

[57] ABSTRACT

A safety gate for use in obstructing doorways, passageways and similar openings to restrict the movement of children. The safety gate includes a panel that can be readily secured in and removed from the opening by extending and retracting a bumper mounted on an outer rail of the panel. The bumper is biased to the extended position in a first direction by a spring that is moved in a second direction transverse to the first direction. The gate can include a pair of extendable bumpers and a pair of springs that independently bias the bumpers to the extended position when moved in the transverse second direction relative to the bumpers. The spring can be a leaf spring having one end attached to a drive member, which can be moved in the first direction, and an opposite end that is slidably supported on a surface of the drive member. The panel can include a pair of panels that slide relative to each other to vary the effective width of the gate so as to correspond to the width of an opening within which the gate is to be positioned.

20 Claims, 8 Drawing Sheets

198
194
204
206
171
208
66
196
200
202
18
236
162
234
192
190
229
226
188
134
170
130
88
230
168
72
154
179
172
178
174
156
220
224
58
56
212
219
136
165
150
216
218
214
226
173
183
132
182
152
38
176
184
180
181
140
185
142
15
16
158
222
148
146
130
158
220
150
218
216
210
58
38
214
50
56
62
136
178
132
219
222
212
210

SAFETY GATE

BACKGROUND OF THE INVENTION

1. Field of the Invention

The present invention relates to a safety gate for use in obstructing doorways, passageways and similar openings to restrict the movement of small children and the like.

2. Description of Related Art

A variety of gates are known and presently on the market that are designed to prevent children from passing from one area to another or from ascending or descending stairways. Several of these gates can be adjusted for use in openings having various widths. Several of these gates also include moveable bumpers that can be extended from and retracted into the gate to respectively secure and release the gate from the opening.

A disadvantage of known gates that utilize moveable bumpers is that the mechanisms used to actuate the bumpers are complex and expensive. These gates conventionally incorporate mechanisms that include numerous interconnecting parts that require precise fits and positioning to interact with each other to extend and retract the bumpers. Gates are also known that utilize actuating mechanisms that include a complex arrangement of links, cranks, pullrods and springs that are interconnected to a pull handle. An example of such an actuating mechanism is disclosed in U.S. Pat. No. 5,052,461.

Another disadvantage associated with known gates is an inability of the moveable plungers to independently compensate for different spacings between each bumper and the side member of an opening. Different spacings can result from various factors such as surface irregularities of the vertical members of an opening, an opening having nonparallel vertical members and the like. Conventionally, known gates use rigid connections between the bumpers and actuating mechanism that can result in a bumper making minimal or no contact with a vertical member of the opening or a bumper exerting a very high force against the vertical member of an opening. U.S. Pat. No. 5,052,461, discussed above, is an example of a gate that incorporates a pair of spring loaded plungers to accommodate irregular door frames and control the forces exerted by the plungers. However, the actuating mechanism incorporated in this gate is a complex assemblage of parts that is expensive to manufacture.

Accordingly, it is an object of the present invention to provide an improved safety gate that overcomes these and other disadvantages associated with known gates.

SUMMARY OF THE INVENTION

In one illustrative embodiment of the invention, a safety gate is provided for obstructing an opening defined by at least one vertical member. The safety gate comprises at least one panel including an outer rail, at least one bumper mounted on the outer rail and movable in a first direction between an extended position and a retracted position, and at least one spring mounted on the outer rail and movable in a second direction that is transverse to the first direction between a first and a second position. The panel in use is positioned within the opening, and the bumper constructed and arranged to engage a vertical member of the opening in the extended position to secure the gate in the opening and to disengage the vertical member in the retracted position to remove the gate from the opening. The spring biases the bumper toward the extended position when the spring is moved toward its first position.

While in the embodiment illustrated two bumpers are shown with a separate spring the gate may include fewer or greater number of bumpers and springs. The springs can independently bias their respective bumpers toward the extended position when the springs are moved toward the first position.

In another illustrative embodiment, the safety gate comprises a panel that includes an outer rail, at least one bumper mounted on the outer rail and movable between an extended position to engage the vertical member and a retracted position to disengage the vertical member, a drive member mounted on the outer rail, and at least one leaf spring coupled to the drive member and disposed adjacent each movable bumper. The drive member is movable between a first position and a second position and the leaf spring or springs is constructed and arranged to bias its bumper toward the extended position, when the drive member is moved toward the first position.

The leaf spring can have a generally bell curve shape that engages a cam surface on a plunger of the bumper when the leaf spring is moved toward the first position. Each bumper may have its own leaf spring, and the leaf springs independently bias their respective bumpers toward the extended position.

In a further illustrative embodiment of the invention, the safety gate includes a panel adapted to be positioned within an opening, engaging means for frictionally engaging a vertical member defining one side of the opening, actuating means for moving the engaging means, and spring means for biasing the engaging means against the vertical member. The engaging means are mounted to the frame to move in a first direction, and the actuating means are mounted on the frame adjacent the engaging means to move between a locked position and an unlocked position in a second direction that is transverse to the first direction. The spring means bias the engaging means in the first direction when the actuating means is moved toward the locked position. The spring means are mounted on the actuating means to be moved between the locked and unlocked positions.

BRIEF DESCRIPTION OF THE DRAWINGS

It should be understood that the drawings are provided for the purpose of illustration only and are not intended to define the limits of the invention. The foregoing and other objects and advantages of the present invention will become apparent with reference to the following detailed description when taken in conjunction with the following drawings in which:

FIG. 15 is an enlarged cross-sectional plan view of a fully extended bumper of the safety gate taken along section line 15—15 in FIG. 13;

DETAILED DESCRIPTION

The present invention is directed to a safety gate that can be positioned in an opening, such as a doorway, to prevent small children, pets and the like from passing through the opening.

Figure 1:
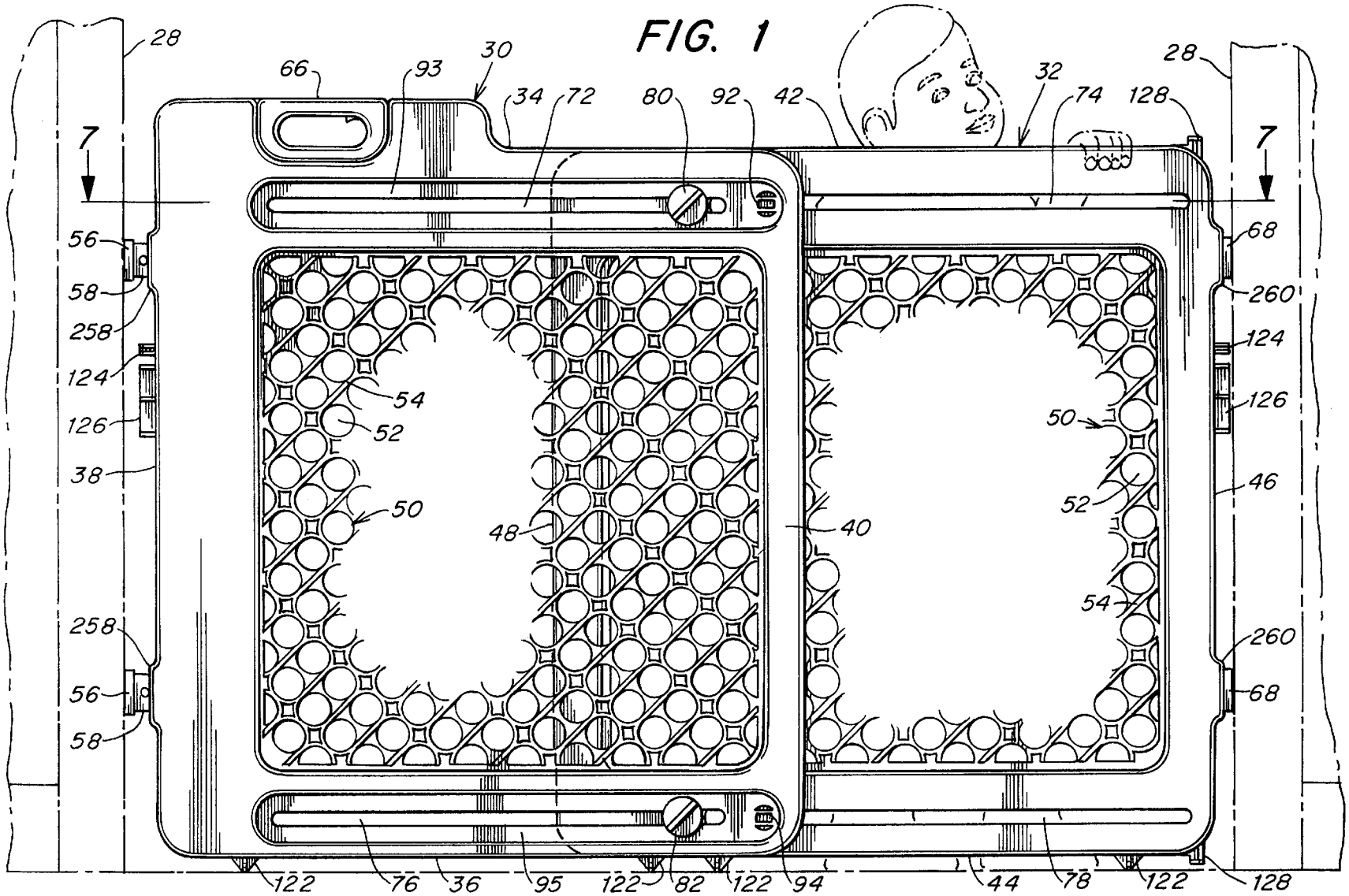
FIG. 1 is a front elevational view of a safety gate of the present invention mounted in a doorway.
Figure 2:
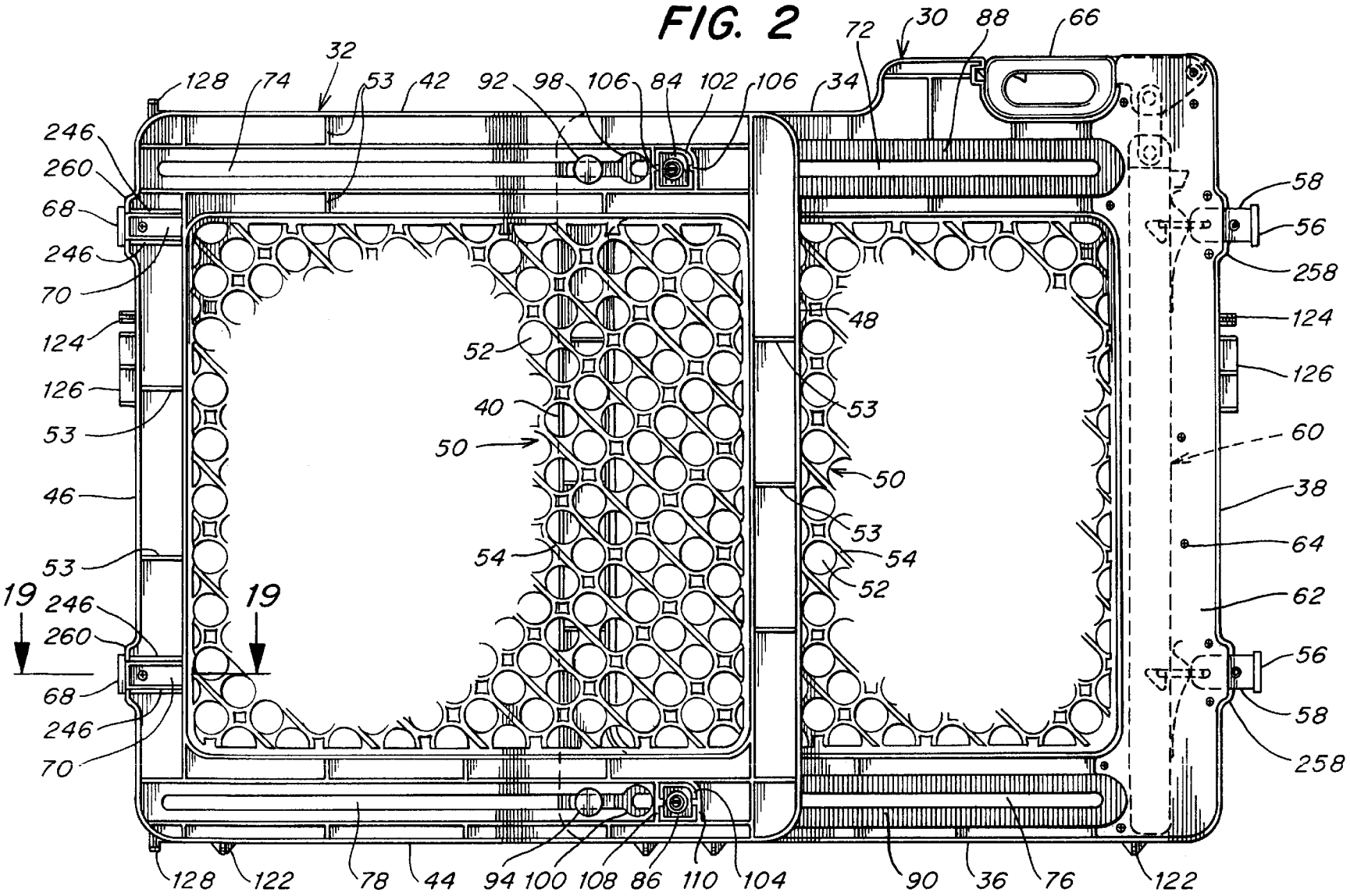
FIG. 2 is a rear elevational view of the safety gate of FIG. 1.
Figure 3:
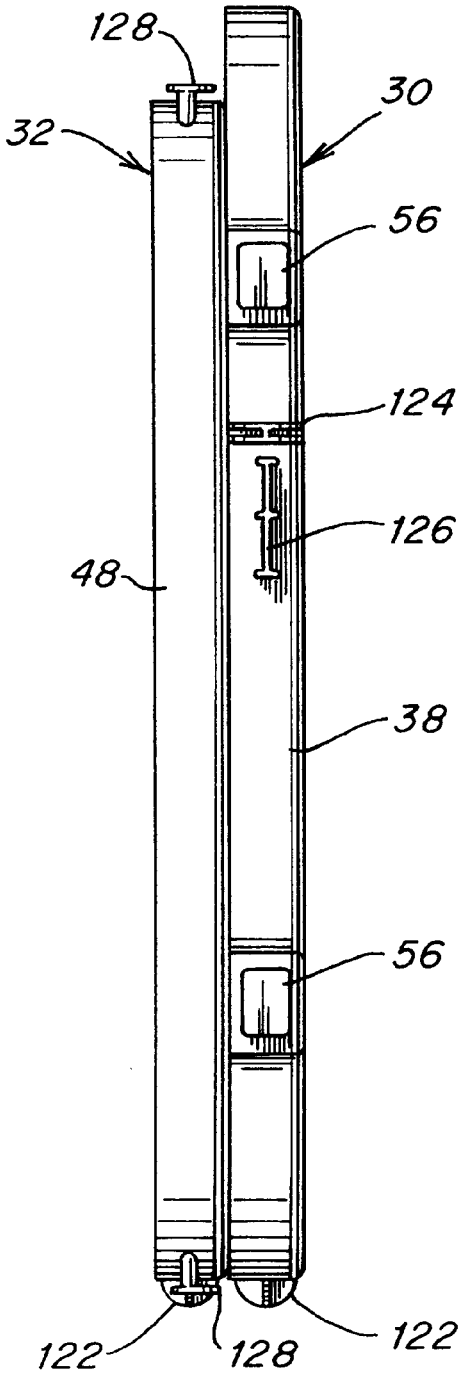
FIG. 3 is a left side elevational view of the safety gate of FIG.1.
Figure 4:
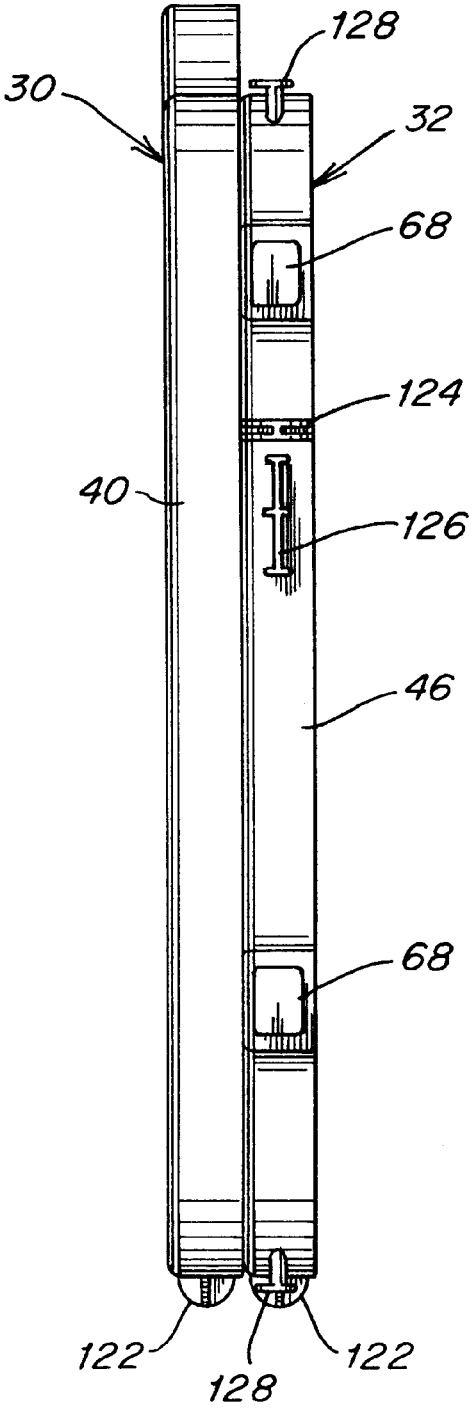
FIG. 4 is a right side elevational view of the safety gate of FIG. 1.
Figure 5:
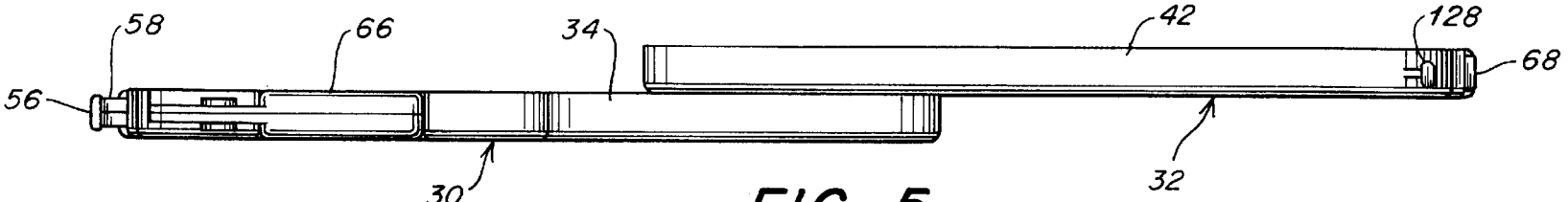
FIG. 5 is a top plan view of the safety gate of FIG. 1.
Figure 6:
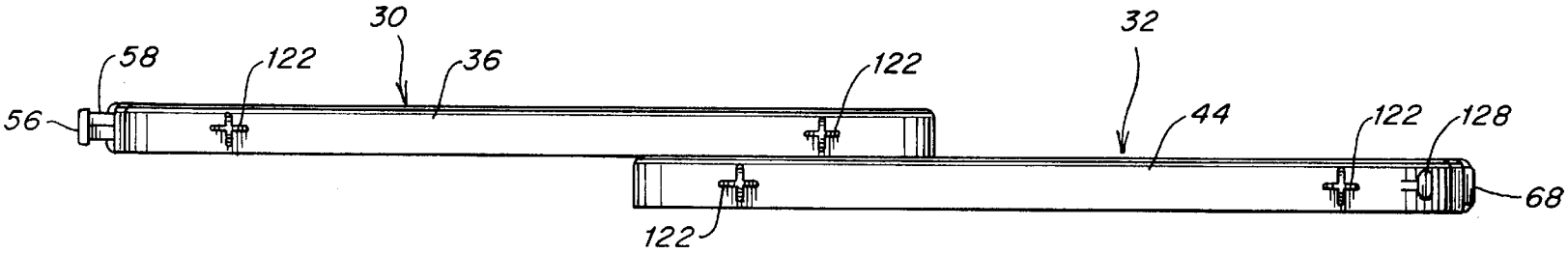
FIG. 6 is a bottom plan view of the safety gate of FIG. 1.

FIGS. 1 and 2, respectively, are front and rear elevational views of the safety gate, wherein the safety gate shown in FIG. 1 is positioned in an opening between opposing vertical side members 28 of the opening. The safety gate includes a front panel 30 and a rear panel 32 slidably connected to the front panel 30 so that the overall width dimension of the gate can be varied to accommodate the particular opening that a user may wish to obstruct with the gate. The front panel 30 includes a top rail 34, a bottom rail 36, an outer rail 38 and an inner rail 40. Similarly, the rear panel 32 includes a top rail 42, a bottom rail 44, an outer rail 46 and an inner rail 48. The front and rear panels can be molded from a plastic material using known processes. The outer rails 38, 46, and the inner rails 40, 48 are vertical and interconnect the horizontal top rails 34, 42 and bottom rails 36, 44. The area of each panel encompassed by the rails includes a mesh-type screen 50 that can be integrally molded with the rails and is comprised of a matrix of round holes 52 that are interconnected by ribbed webbing 52 which prevents passage of a child through the panels. As illustrated throughout the figures, the front and rear panels 30, 32 include various integrally formed ribs 53 to increase the stiffness of the panels.

The safety gate includes a pair of bumpers disposed on the outer face of each of the respective outer rails 38, 46. A pair of extendable bumpers 56 are connected to movable plungers 58 which can be extended from and retracted into the outer rail 38 of the front panel 34 using a drive mechanism 60 that is disposed in the front panel outer rail 38 as described more fully below. A cover 62 (FIG. 2) is attached to the rear of the front panel outer rail 38 using a plurality of fasteners 64, such as screws, to protect and retain the drive mechanism 60 within the outer rail 38. The drive mechanism 60 can be actuated to extend and retract the bumpers 56 using a handle 66 that is pivotally connected to the upper portion of the front panel outer rail 38.

A pair of stationary bumpers 68 are disposed on the outer face of the rear panel outer rail 46. The stationary bumpers 68 are attached to the rail 46 using wedge-shaped retention covers 70 (FIG. 2). The stationary bumpers 68 cooperate with the extendable bumpers 56 to securely retain the safety gate between the vertical members 28 of the opening in which the gate is mounted. The extendable and stationary bumpers 56, 58 can be identical parts molded from a non-marring elastomeric material having a high gripping surface.

Figure 7:
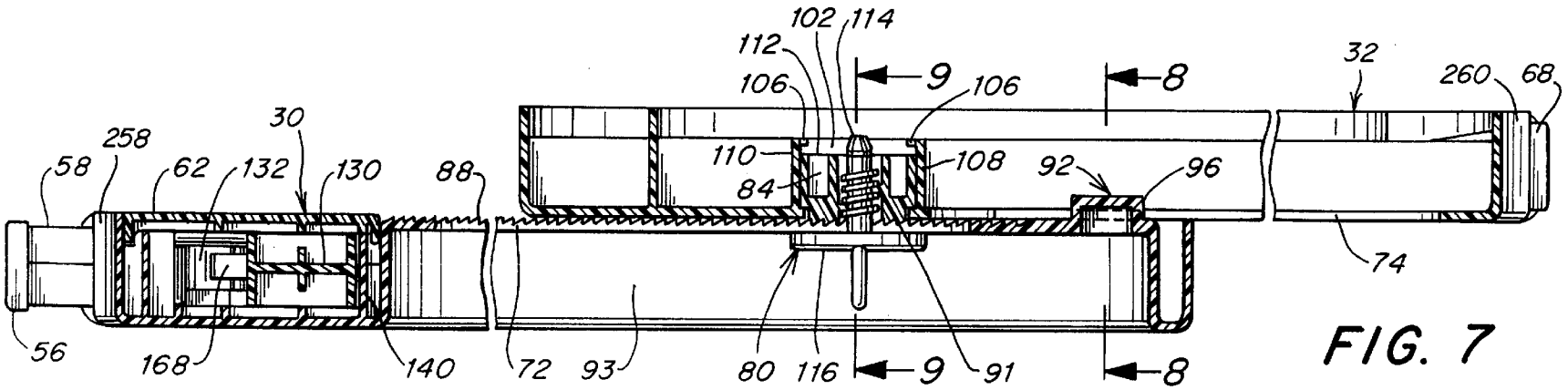
FIG. 7 is a cross-sectional top plan view of width adjustment means of the safety gate of FIGS. 1–6 taken along section line 7—7 in FIG. 1.

The front and rear panels 30, 32 include, respectively, upper adjustment slots 72, 74 and lower adjustment slots 76, 78. The upper adjustment slots 72, 74 extend longitudinally along the top rails 42. Similarly, the lower adjustment slots 76, 78 extend longitudinally along the bottom rails 36, 44. Each of the upper adjustment slots 72, 74 and lower adjustment slots 76, 78 align with each other and cooperate with thumb screws 80, 82 and their respective lock nuts 84, 86 to enable a user to selectively adjust the overall width of the gate and to secure the front and rear panels 30, 32 to each other in any selected effective width limited only by the sizes of the panels and the lengths of the slots. To ensure that the panels 30, 32 are firmly held in the selected width, a plurality of vertical serrations 88, 90 are disposed on the rear face of the front panel 30 above and below the upper and lower adjustment slots 72, 76. The serrations 88, 90 interlock with corresponding serrations 91 (FIG. 10) disposed on the front face of the lock nuts 84, 86 as the panels are squeezed together when the thumb screws 80, 82 are tightened into the lock nuts 84, 86. As best shown in FIGS. 1 and 7, each thumbscrew 80, 82 is disposed within an elongated cavity 93, 95 to minimize the depth of the safety gate and reduce projections from the surfaces of the panels.

Figure 8:
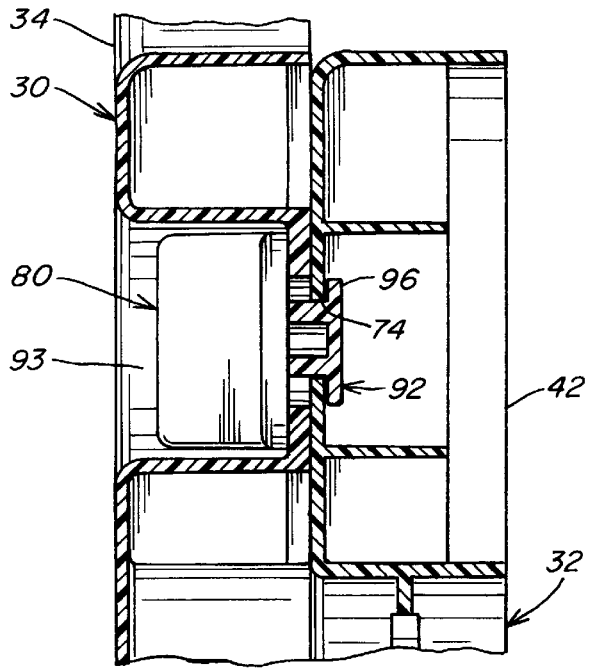
FIG. 8 is an enlarged cross-sectional side view of the width adjustment means of the safety gate taken along section line 8—8 in FIG. 7.

To further stabilize the connection between the front and rear panels 30, 32, a pair of locking posts 92, 94 are integrally formed with and protrude from the rear surface of the top and bottom rails 42 and 44 of the front panel 30 adjacent the ends of the upper and lower adjustment slots 72, 76. As shown in FIGS. 2, 7 and 8, the locking posts 92, 94 extend through the upper and lower adjustment slots 74, 78 of the rear panel 32. Each locking post 92, 94 includes a circular head 96 (FIGS. 7 and 8) having a diameter that is greater than the width of the slots 74, 78 to maintain the posts in the slots as the front and rear panels 30, 32 are adjusted to a desired width for the safety gate. To facilitate assembly of the front and rear panels 30, 32, oversized holes 98, 100 (FIG. 2) are disposed at the ends of the upper and lower adjustment slots 74, 78 of the rear panel 32 adjacent the lock nuts 84, 86. The holes 98, 100 have a diameter that is greater than the diameter of the heads 96 of the locking posts so that the heads can be inserted into the corresponding slots.

Figure 9:
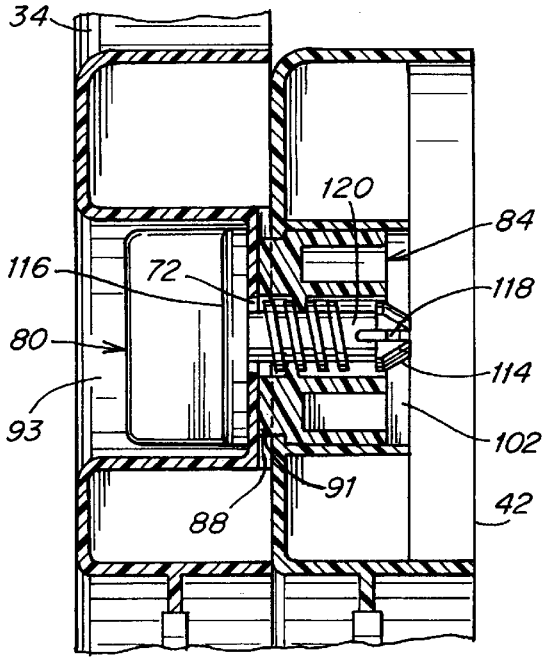
FIG. 9 is an enlarged cross-sectional side view of the width adjustment means of the safety gate taken along section line 9—9 in FIG. 7.

As shown in FIGS. 2, 7, 9 and 10, the lock nuts 84, 86 nest within cavities 102, 104 integrally formed on the rear surface of the rear panel 32 in the top and bottom rails 42, 44 adjacent the inner rail 48. When the thumb screws 80, 82 are loosened so as to permit adjustment of the effective width of the safety gate and the front and rear panels 30, 32 are moved relative to each other, the thumb screws 80, 82 and their corresponding lock nuts 84, 86 remain fixed with respect to the rear panel 32 and slide along the upper and lower adjustment slots 72, 76 of the front panel 30. Similarly, the locking posts 92, 94 remain fixed with respect to the front panel 30 and slide along the upper and lower adjustment slots 74, 78 of the rear panel 32. To retain the lock nuts 84, 86 in the cavities 102, 104, a pair of lock tabs 106 are provided on opposing sidewalls 108, 110 of each cavity that extend into the cavity toward each other. As best shown in FIGS. 7 and 9, the depth of each cavity 102, 104 is greater than the height of the lock nuts 84, 86 so that the lock tabs 106 will engage the rear edge 112 of the lock nuts and retain them within the cavities.

Figure 10:
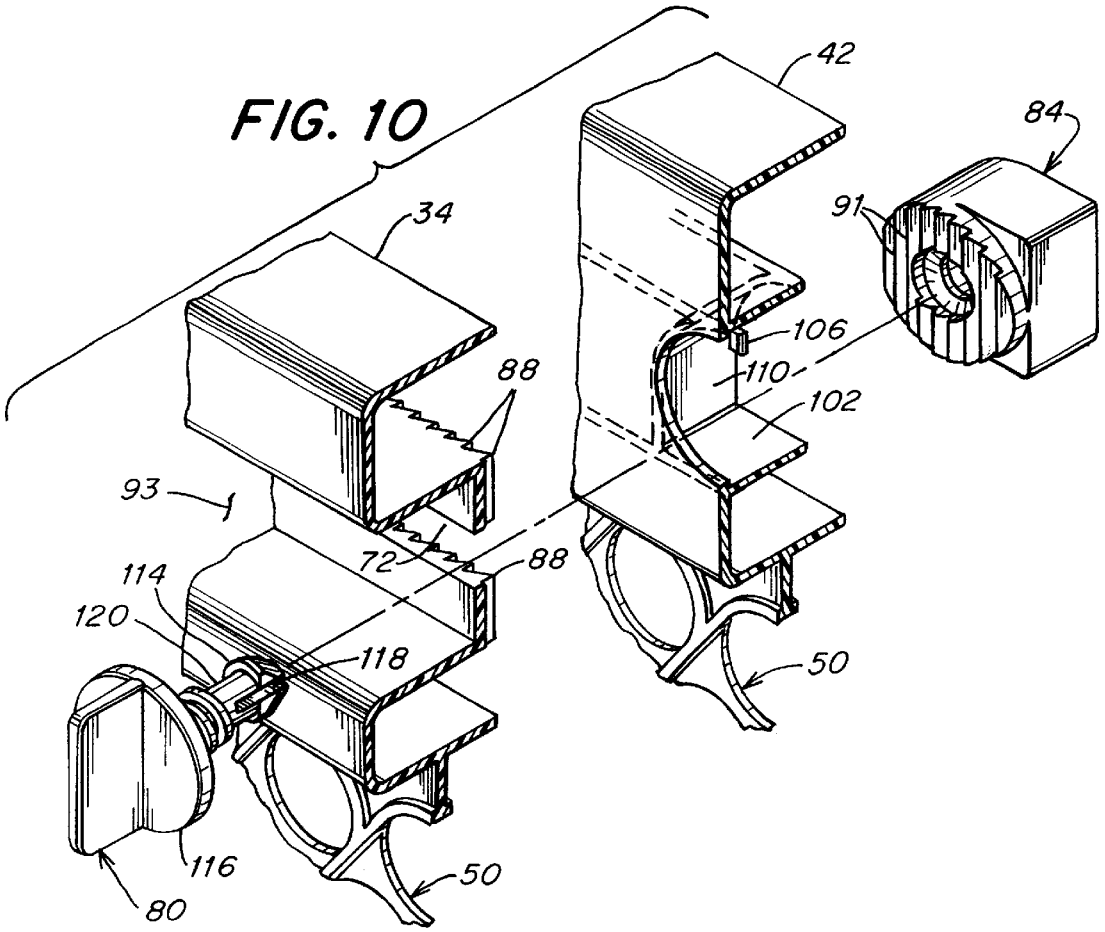
FIG. 10 is an exploded perspective view of the safety gate width adjustment means of FIGS. 7–9.

As shown in FIGS. 9 and 10, to insure that the thumb screws 80, 82 do not completely disengage from the lock nuts when loosened, the thumb screws 80, 82 are formed with a barb-like tip 114 which flares outwardly from the tip toward the head portion 116 of the thumb screws. The barb-like tip 114 facilitates insertion of the thumb screws 80, 82 into the lock nuts 84, 86 and prevents easy extraction of the thumb screws from the lock nuts. To further facilitate insertion of the thumb screws into the lock nuts, each thumb screw has a slot 118 extending through the tip which allows the tip 114 to flex inwardly as the thumb screws are inserted into the lock nuts. A portion 120 of the thumb screws adjacent the tip 114 should be free of threads to ensure that the thumb screws are not inadvertently unscrewed from the lock nuts past the barbed tip.

As shown in FIGS. 1–6, a pair of support feet 122 are integrally formed on the bottom face of the bottom rails 36, 44 of the front and rear panels 30, 32 to support the safety gate above a surface such as a floor. To allow the safety gate to be mounted in openings using various mounting techniques, various brackets can be provided on the safety gate. As illustrated, horizontal and vertical brackets 124, 126 can be provided on the outer faces of the outer rails 38, 46 of the front and rear panels 30, 32. The brackets 124, 126 can be configured to interconnect with corresponding brackets (not shown) that are separately mounted to the vertical members of an opening such as a door frame. Further, a pair of vertical hinge pins 128 can be provided on the rear panel 32 to extend from each end of the outer rail 46 and can be configured to interlock with hinge brackets (not shown) to allow the safety gate to be pivotally mounted in an opening. Various methods of mounting the safety gate using brackets and hinges are described in further detail in U.S. Pat. No. 5,367,829 (Crossley et al.), which is incorporated herein by reference.

As discussed above, the safety gate can be secured in and removed from an opening by extending and retracting the extendable bumpers 56 disposed in the outer rail 38 of the front panel 30. The drive mechanism used to extend and retract the bumpers can be actuated by the pivotally mounted handle 66 and is illustrated in FIGS. 11–18.

Figure 11:
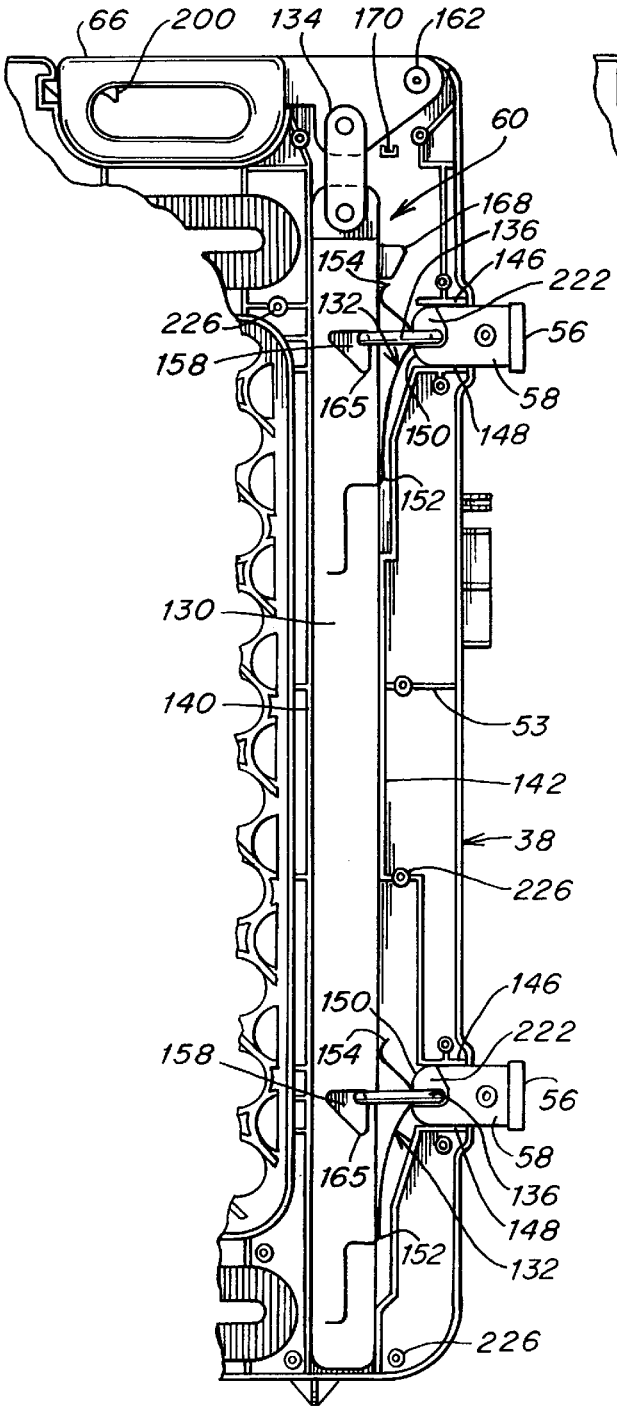
FIG. 11 is a fragmentary rear elevational view of an actuating mechanism of the safety gate of FIGS. 1–6 illustrating bumpers in a fully extended position.
Figure 12:
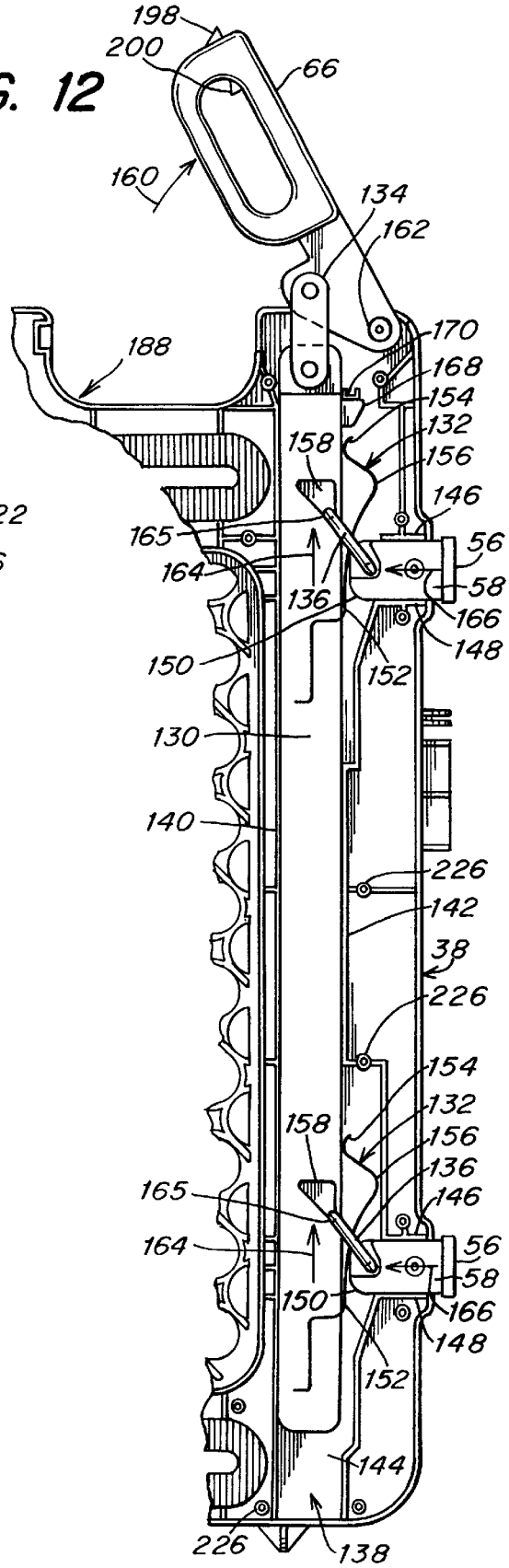
FIG. 12 is a fragmentary rear elevational view of the actuating mechanism of the safety gate of FIGS. 1–6 illustrating the bumpers in a retracted position.

FIGS. 11 and 12 are fragmentary rear views of the outer rail 38 with the cover 62 removed to schematically illustrate the drive mechanism 60 used to extend and retract the extendable bumpers 56. The drive mechanism 60 includes an elongated slide 130, a pair of leaf springs 132 made of hardened spring steel and attached to the slide 130, a pair of slide links 134 connecting the slide 130 to the handle 66, and a pair of plunger links 136 connecting each plunger 58 to the slide 130. The slide 130 slidably nests within a vertical, generally U-shaped channel 138 defined by opposing sidewalls 140, 142 and a front wall 144. The slide 130 moves vertically in the channel 138 in response to the pivoting movement of the handle 66 and the leaf springs 132 also move vertically with the slide. The pivoting movement of the handle 66 is translated to the slide 130 through the slide links 134 which pivotally connect the handle and slide.

The plungers 58, similar to the slide 130, slidably nest within horizontal channels in the outer rail 38 which are defined by opposing horizontal sidewalls 146, 148 and a portion of the front wall of the outer rail. The plungers 58 are extended from and retracted into the outer rail 38 in response to the vertical movement of the slide 130. The leaf springs 132 are disposed between the slide 130 and the plungers 58 so as to engage a cam surface 150 on the rear of each plunger. Each leaf spring 132 is generally bell curved along the length of the slide 130, and the fixed lower end 152 of the spring is attached to the slide while its free upper end 154 slidably engages the slide surface.

As illustrated in FIG. 11, when the handle 66 is in a closed position, the leaf springs 132 are positioned relative to the plungers 58 so that the apex 156 of each spring engages the cam surface 150 of each plunger, thereby forcing the plungers to extend from the outer rail 38. In FIG. 11, the plungers 58 are shown in their fully extended position which is established by the plunger links 136 that interconnect the plungers 58 to the slide 130. The springs 132 should be configured so that they are placed under some compression when the spring apexes 156 engage the plungers to ensure that the plungers remain extended. The plunger links 136 are made of U-shaped rod with one end of each plunger link being pivotally connected to a plunger 58 and the opposite end of the plunger link being positioned within a triangular-shaped cavity 158 formed in the slide 130. When the plungers are in their fully extended position, the plunger links engage a front vertical wall of their respective cavities 158 to restrict the extension of the plunger from the outer rail 38.

To retract the bumpers 56, the handle 66 is released and pivoted in a clockwise direction 160 as shown in FIG. 12. The handle 66 pivots on a boss 162 in an upper corner of the front panel 30 at the intersection of the top and outer rails 34, 38. The slide 130 in turn is slid in an upward direction as indicated by arrow 164 due to the interconnection between the handle 66 and the slide 130 through the slide links 134. As the slide 130 is moved in the upward direction 164, the leaf springs 132 likewise are moved in the upward direction so that the apex 156 is moved out of engagement with the plunger 58 thereby releasing the biasing force on the plunger. Further, as the slide 130 is being moved in the upward direction 164, the plunger links 136 engage a 10 bottom corner 165 of the triangular cavity 158 thereby pivoting the plunger links 136 on the plungers 58 and retracting the plungers in a horizontal direction 166 into the outer rail 38. The maximum rotation of the handle 66 is restricted by a finger 168 protruding from the upper portion of the slide 130, which engages a stop 170 on the rear surface of the front panel 30 adjacent the slide 130.

Figures 13, 14:
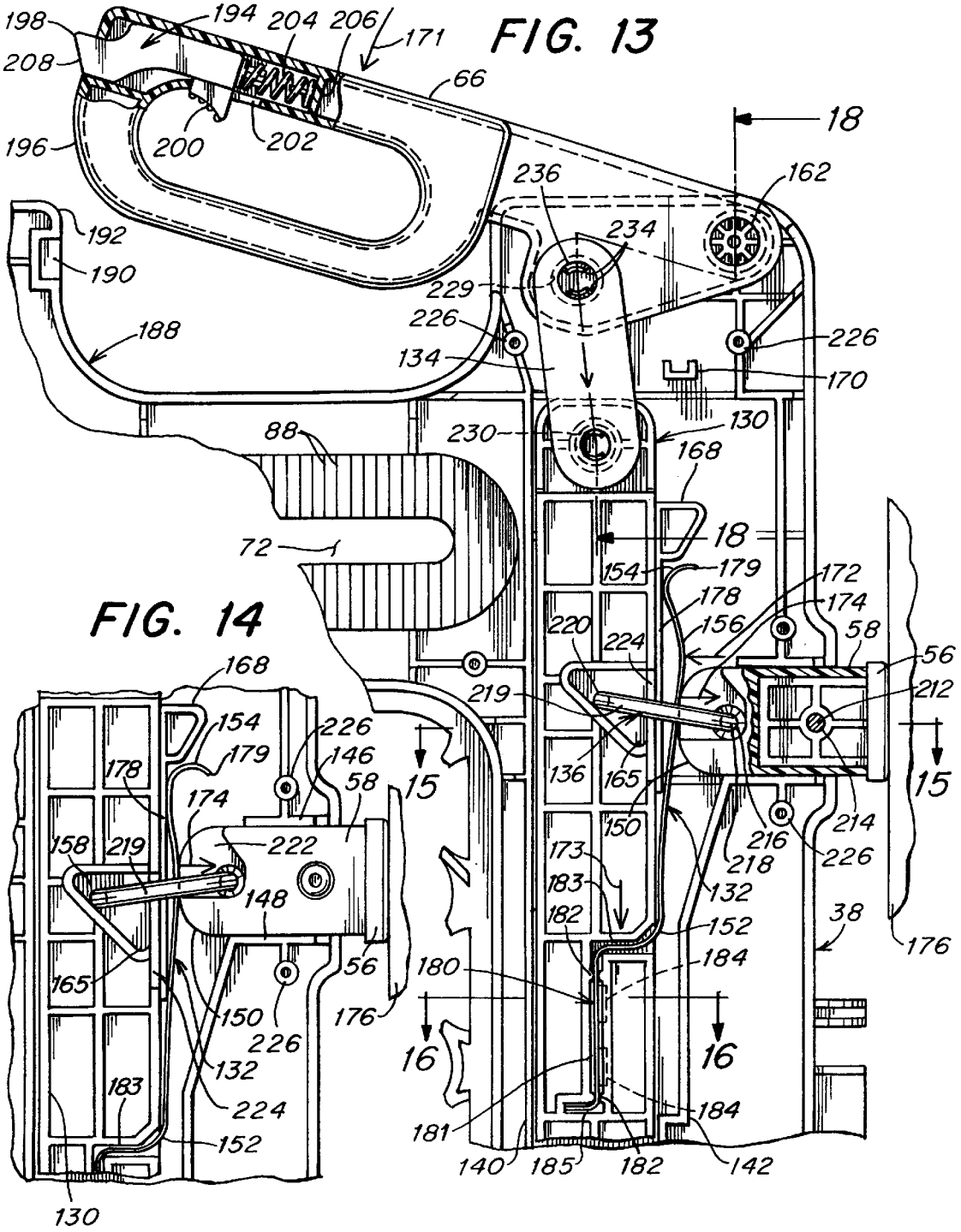
FIG. 13 is an enlarged fragmentary rear view of the actuating mechanism of the safety gate of FIGS. 1–6 illustrating a bumper being partially engaged against a vertical member of an opening.
FIG. 14 is an enlarged fragmentary view of the bumper of FIG. 13 being fully engaged against the vertical member.

The overall width of the safety gate is preferably adjusted within an opening so that the plungers 58 cannot be fully extended when the handle 66 is pivoted downwardly to its closed locking position. As illustrated in FIGS. 13 and 14, when the extension of a plunger 58 is restricted by the vertical side member of an opening, such as a door jamb, the leaf spring 132 compresses as the slide 130 moves in a downward direction 171 until the apex 156 is positioned to engage the cam surface 150 of the plunger. A spring compression force 172, which is proportional to the spring compression, produces a corresponding reaction force 174 between the bumper 56 and the door jamb 176 to secure the safety gate in the opening. Therefore, the less the plungers are allowed to extend from the outer rail 38 when the handle 66 is closed, the more the leaf springs 132 are compressed and the greater the reaction force 174 that is generated to hold the safety gate within the opening.

An advantage of this spring arrangement is the independent interaction of each spring 132 with its corresponding plunger 58 which can compensate for different spacings between each bumper 56 and the vertical member of the opening. The different spacings can be due to various factors such as surface irregularities of the vertical members, an opening having nonparallel vertical members and the like. When the slide 130 is moved in the downward direction 173 in response to the counterclockwise rotation 171 of the handle 66, each spring 132 engages and extends a plunger 58 from the outer rail until its corresponding bumper 56 engages the vertical member. Thereafter, each spring 132 is independently compressed in proportion to the particular spacing between the bumper 56 and the vertical member. Thus, the spring 132 corresponding to the first plunger 58 to engage the vertical member will be compressed by a greater amount than the other spring 132 resulting in a higher reaction force between the first plunger and the vertical member.

A rub rail 178 can be provided on the side of the slide 130 adjacent the plungers 58. The rub rails 178 are narrower than the width of the leaf springs 132 to reduce the contact area and frictional force between the slide 130 and the free upper end 154 of the spring 132 so that the upper end of the spring can move more easily with respect to the slide as the spring is being compressed and released to extend and retract the plungers 58. The rub rail 178 also raises the free end 154 of the spring 132 above the slide surface to prevent the edges of the spring 132, which may be sharp and/or carry burrs, from engaging the slide 130 and avoid damage to the slide. For similar reasons, the free upper end 154 of each spring 132 is curved upwardly away from the slide 130 to provide a smooth interface between the rub rail and the spring so that the tip 179 does not cut into the slide.

Figure 16:
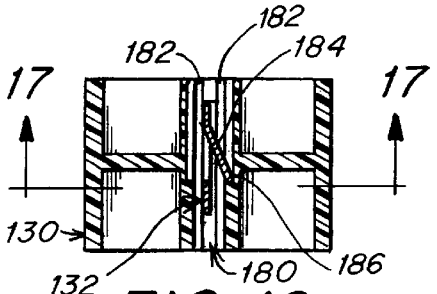
FIG. 16 is a cross-sectional top view of spring retention means of the actuating mechanism of the safety gate taken along section line 16—16 in FIG. 13.
Figure 17:
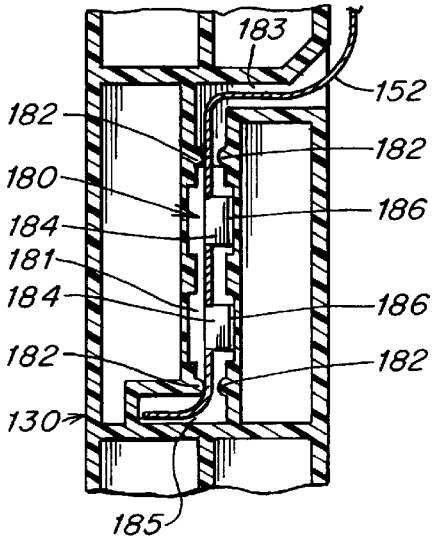
FIG. 17 is a cross-sectional front view of the spring retention means of the actuating mechanism of the safety gate taken along section line 17—17 in FIG. 16.

As best shown in FIGS. 13, 16 and 17, the lower end 152 of each spring 132, which attaches the spring to the slide 130, is generally S-shaped and is disposed in a similarly shaped channel 180 in the slide. The channel 180 has a vertical portion 181 extending between horizontal top and bottom portions 183, 185 that extend in opposite directions from the ends of the vertical portion 181. The vertical portion 181 includes a pair of oppositely disposed ribs 182 at its upper and lower ends which are arranged to engage and support the spring in the channel. A pair of cantilever members 184 as shown in FIGS. 13, 16, and 17 may be provided on the vertical portion of the lower end of the spring to retain the leaf spring 132 in the channel 180 so that it remains attached to slide 130. As shown in FIG. 16, the tip 186 of the cantilever member 184 can engage a shoulder on the sidewall of the channel to retain the lower end 152 of the spring in the channel. When the lower end 152 of the spring is pressed into the channel 180, the cantilever members 184 deflect inwardly to create a retaining force between the cantilever member and the channel.

The top rail 34 of the front panel has a generally U-shaped seat 188 which is contoured to receive the handle 66 in the closed position. The seat 188 includes a cavity 190 (see FIG. 13) portion of the inner side wall 192, which receives a finger actuated lock 194 carried on the free end 196 of the handle 66. When the handle 66 is pivoted to the horizontal closed position to extend the bumpers 56, a locking finger 198 disposed on the end of the lock 194 is received within the cavity 190 to lock the handle 66 in the closed position so that the bumpers 56 remain extended to secure the gate in place. Therefore, a child cannot remove the gate from an opening simply by pulling upwardly on the handle 66 and thereby relieve the holding pressure on the bumpers 56. However, an adult can release the lock 194 by pulling on the retraction button 200 extending downwardly from the lock through a slot 202 in the handle. The lock 194 is biased to extend out of the handle 66 and toward the handle lock cavity 190 by a compression spring 204 which is disposed between the lock 194 and an internal wall 206 of the handle. When the handle is being pivoted to the horizontal position to extend the plungers 56, an angled face 208 of the locking finger 198 engages the upper portion of the inner side wall 192 urging the lock 194 to retract into the handle 66 until the locking finger 198 aligns with the cavity 190 and snaps into the cavity 190 under the action of the compression spring 204 to lock the handle 66 in the closed position. To actuate the handle 66 and retract the bumpers 56, the locking finger 198 is retracted from the cavity 190 by sliding the handle lock 194 away from the cavity 190 against the action of the spring 204 using the retraction button 200.

Each bumper plunger 58 includes two identical members 210 (see FIG. 15) which are joined to each other with a fastener 212 such as a rivet. The bumper 56, which has a generally T-shaped cross-section, is sandwiched between the members 210 and is retained by means of the fastener 212 which extends through a hole 214 in the bumper 56. The plunger has a hole 216 disposed adjacent its cam surface 150 to pivotally receive one end 218 of the U-shaped plunger link 136. As described above, the other end 220 of the plunger link is received within the triangular cavity 158 formed in the slide 130 to retract the plunger when the slide is moved upwardly.

Each plunger 58 also has with a recess 222 disposed about the hole 216 to receive the central portion 219 of the link 136 that is extends between the ends 218, 220 so as to reduce the depth of the outer rail. Similarly, a portion of wall 224 of the slide 130 is removed adjacent the triangular cavity to receive the center portion 219 of the link located between the cavity and plunger. The plunger links 136 are retained in the plungers 58 and cavities 158 by the cover 62 which is fastened to a plurality of molded bosses 226 on the rear of the front panel 30.

Figure 18:
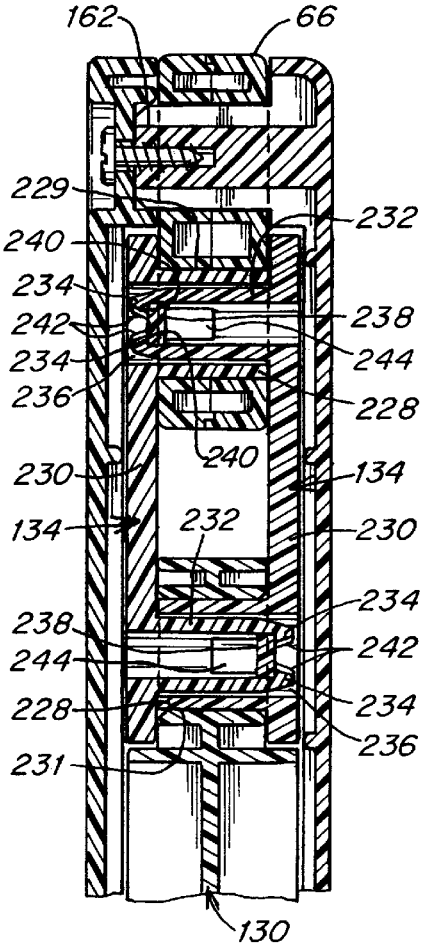
FIG. 18 is an enlarged cross-sectional side view of actuating linkage of the actuating mechanism of the safety gate taken along section line 18—18 in FIG. 13 illustrating the handle in a locked position.

In FIG. 18, the handle 66 and the slide 130 are shown interconnected by a pair of interlocking slide links 134 disposed on opposite sides of the slide and the handle. The slide links 134 can be identical molded plastic parts which snap fit to each other.

Each slide link 134 includes an annular bearing post 228 protruding from one end of the face of an elongated link body 230. The bearing post 228 is adapted to extend through and peripherally engage axially aligned connection holes 229, 231 in the handle 66 and slide 130. Each slide link 134 also includes an annular locking post 232 protruding from the opposite end of the face of the elongated link body 230. The slide links 134 are aligned with each other so that the locking post 232 on one slide link is disposed within the bearing post 228 on the opposing slide link. The tip of each locking post 232 includes an opposing pair of arcuate locking tabs 234 (FIG. 13). Each tab 234 extends through a corresponding arcuately shaped aperture 236 provided on a lock wall 238 disposed inside the bearing post 228 adjacent the link body 230. Each tab 234 has a shoulder 240 that engages the lock wall 238 when the tab 234 extends through the aperture 236, to interlock the pair of slide links 134. To facilitate the insertion of the locking tabs 234 through the locking apertures 236, each tab has an inclined cam surface 242 that engages a cam post 244 as the locking post is inserted into the bearing post 228 so as to deflect the tabs 234 away from each other until they protrude through the apertures 236.

The stationary bumpers 68 (see FIGS. 19 and 20) are attached to the outer rail 46 of the rear panel 32 and cooperate with the extendable bumpers 56 to retain the safety gate between the vertical sides of an opening closed by the gate. As described above, each stationary bumper 68 may be identical to the extendable bumper 58 having a generally T-shaped cross section. Each stationary bumper 68 is positioned in a recess formed in the outer rail 46 by a plurality of ribs 246 integrally molded in the rail. Each bumper 68 is mounted on a support post 248 protruding from the front wall of the outer rail 46. The bumper 68 is sandwiched between the recessed ribs 246 and a wedge shaped retention cover 70 which engages the ribs 246 and is fastened to the post 248 by a fastener 250 such as a screw.

Figure 19:
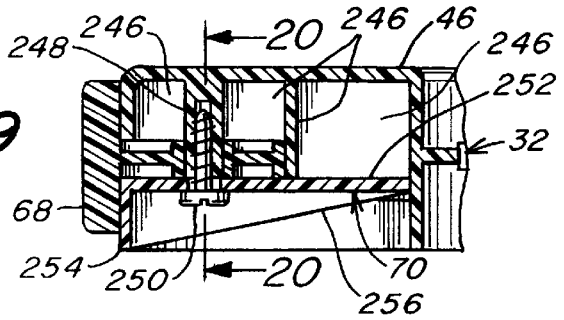
FIG. 19 is a cross-sectional top view of a stationary bumper of the safety gate of FIGS. 1–6 taken along section line 19—19 in FIG. 2.
Figure 20:
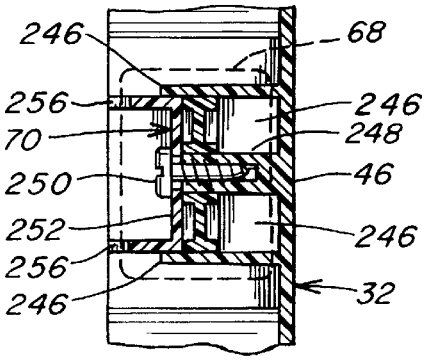
FIG. 20 is a cross-sectional side view of the stationary bumper of the safety gate of FIGS. 1–6 taken along section line 20—20 in FIG. 19.

As best shown in FIG. 19, the retention cover 70 has an L-shaped cross section and includes a plate 252, a flange 254 and a pair of opposed gussets 256 extending along the length of the cover 70 to strengthen the flange. The flange 254 is positioned coplanar with the outer surface of the outer rail 46 to support the bumper 68 when it is compressed against the vertical side of the opening.

As best shown in FIGS. 1 and 2, each of the extendable bumpers 56 and stationary bumpers 68 is positioned on an elevated platform portion 258, 260 on the outer surfaces of the outer rails 38, 46, respectively. The platforms 258, 260 space the bumpers 56, 68 from the outer surface of the outer rails 38, 46 to ensure that the horizontal and vertical brackets 124, 126 protruding from the outer surface of the outer rails do not engage the vertical sides 28 of the opening when the safety gate is in place.

Having described a particular embodiment of the invention in detail, various modifications and improvements will readily occur to those skilled in the art. Such alterations, modifications and improvements are intended to be part of this disclosure, and within the spirit and scope of the invention. Accordingly, the foregoing description is by way of example only and the invention is defined by the following claims and their equivalents.

What is claimed is:

1. A safety gate for obstructing an opening having a width and a pair of opposing members defining the width, the gate comprising:

at least one panel constructed and arranged to be positioned within the opening, the panel including an outer rail;

first and second bumpers mounted on the outer rail and being movable in a first direction between an extended position and a retracted position, the gate to be secured in the opening when the first and second bumpers are moved to the extended position, the gate to be released from the opening when the first and second bumpers are moved to the retracted position;

a drive member slidably mounted on the outer rail and movable in the second direction the first and second bumpers being coupled to the drive member; and first and second springs mounted on the drive member adjacent the first and second bumpers and being moveable in a second direction that is transverse to the first direction between a first position and a second position, the first and second springs being constructed and arranged to independently bias, respectively the first and second bumpers toward the extended position when the springs are moved toward the first position in the second direction.

2. The safety gate recited in claim 1, wherein the first and second springs are constructed and arranged to be compressed in the first direction when the springs are moved toward the first position in the second direction.

3. The safety gate recited in claim 2, wherein the first and second springs include a leaf spring.

4. The safety gate recited in claim 2, wherein the at least one panel includes a first panel and a second panel adjustably attached to the first panel so that the gate can be adjusted to correspond to the width of the opening.

5. The safety gate recited in claim 1, further comprising first and second bumper links respectively interconnecting the first and second bumpers to the drive member, the first and second bumper links being pivotally connected to the first and second bumpers.

6. The safety gate recited in claim 1, further comprising a handle pivotally mounted on the panel between a locked position and an unlocked position, the handle being coupled to the drive member to move the drive member toward the first position and toward the second position when the handle is pivoted toward the locked position and the unlocked position respectively.

7. The safety gate recited in claim 6, further comprising a slide link interconnecting the handle to the drive member, the slide link being pivotally connected to the handle and the drive member.

8. The safety gate recited in claim 1, wherein the first direction is perpendicular to the second direction.

9. A safety gate for obstructing an opening having a width and a pair of opposing members defining the width, the gate comprising:

at least one panel constructed and arranged to be positioned within the opening, the panel including an outer rail;

at least one bumper mounted on the outer rail and being moveable in a first direction between an extended position and a retracted position, the gate to be secured in the opening when the at least one bumper is moved to the extended position, the gate to be released from the opening when the at least one bumper is moved to the retracted position; and at least one spring mounted on the outer rail and being moveable in a second direction that is transverse to the first direction between a first position and a second position, the at least one spring being constructed and arranged to bias the at least one bumper toward the extended position when the spring is moved toward the first position in the second direction, the at least one spring being constructed and arranged to be compressed in the first direction when the spring is moved toward the first position in the second direction, wherein the at least one bumper includes a plunger having a cam surface disposed adjacent the at least one spring, the at least one spring engaging the cam surface when the spring is moved toward the first position.

10. A safety gate for obstructing an opening having at least one vertical member, the gate comprising:

a panel constructed and arranged to be positioned within the opening, the panel including an outer rail;

at least one bumper mounted on the outer rail and being movable between an extended position to be engaged with the vertical member of the opening and a retracted position to be disengaged from the vertical member;

a drive member mounted on the outer rail and being movable between a first position and a second position; and at least one leaf spring coupled to the drive member and disposed adjacent the at least one bumper, the at least one leaf spring being constructed and arranged to bias the bumper toward the extended position when the drive member is moved toward the first position.

11. The safety gate recited in claim 10, wherein the at least one leaf spring has a generally bell curve shape.

12. The safety gate recited in claim 11, wherein the at least one bumper includes a plunger having a cam surface disposed adjacent the at least one leaf spring, the at least one leaf spring engaging the cam surface when the leaf spring is moved toward the first position.

13. The safety gate recited in claim 12, wherein the at least one leaf spring has an apex that engages the cam surface of the at least one bumper when the leaf spring is moved to the first position.

14. The safety gate recited in claim 12, wherein the at least one bumper includes a first bumper and a second bumper and the at least one leaf spring includes a first leaf spring and a second leaf spring, the first and second leaf springs independently biasing, respectively, the first and second bumpers toward the extended position when the first and second leaf springs are moved toward the first position.

15. The safety gate recited in claim 11, wherein the at least one leaf spring includes a first end and a second end, the first end being attached to the drive member and the second end being slidably supported on a surface of the drive member.

16. The safety gate recited in claim 15, wherein the drive member includes at least one rub rail protruding from the surface, the second end of the leaf spring being supported by the rub rail above the surface of the drive member.

17. The safety gate recited in claim 16, wherein the at least one leaf spring and the at least one rub rail each has a width, the rub rail width being less than the leaf spring width.

18. A safety gate for obstructing an opening having a pair of opposing members, the gate comprising:

a panel constructed and arranged to be positioned within the opening;

engaging means for frictionally engaging one of the opposing members of the opening when the gate is positioned in the opening, the engaging means being mounted to the panel to move in a first direction;

actuating means for moving the engaging means in the first direction, the actuating means being mounted on the panel adjacent the engaging means to move between a locked position and an unlocked position in a second direction that is transverse to the first direction; and spring means for biasing the engaging means in the first direction against the opposing member when the actuating means is moved toward the locked position, the spring means being mounted on the actuating means to be moved between the locked position and the unlocked position.

19. The safety gate recited in claim 18, wherein the opening and the panel each has a width, the safety gate further comprising adjusting means for adjusting the panel width to correspond to the opening width.

20. The safety gate recited in claim 18, wherein the actuating means includes retracting means for retracting the engaging means away from the vertical member when the actuating means is moved toward the unlocked position.

* * * * *

UNITED STATES PATENT AND TRADEMARK OFFICE

CERTIFICATE OF CORRECTION

PATENT NO. : 5,924,242

DATED : July 20, 1999

INVENTOR(S) : Jaon Macari, et al.

It is certified that error appears in the above-identified patent and that said Letters Patent is hereby corrected as shown below:

Column 3, line 60, change "52" to --54--.

Column 4, line 2, change "34" to --30--.

Column 4, line 19, change "58" to --68--.

Column 4, line 24, insert --34 and-- before 42.

Column 6, line 29, before "U-shaped rod" insert --a--.

Column 6, line 64, change "171" to --173--.

Signed and Sealed this

Fourteenth Day of September, 1999

*Attest:*

Q. TODD DICKINSON

*Attesting Officer*

*Acting Commissioner of Patents and Trademarks*